United States Patent [19]

Lavigne et al.

[11] 3,965,993

[45] June 29, 1976

[54] WELL BORE PERFORATING APPARATUS

[75] Inventors: Jean Lavigne, Chevreuse; Pierre Chesnel, Savigny-sur-Orge; Gerard Bouguyon, Plaisir, all of France

[73] Assignee: Schlumberger Technology Corporation, New York, N.Y.

[22] Filed: Sept. 8, 1975

[21] Appl. No.: 610,945

[30] Foreign Application Priority Data

Sept. 20, 1974 France ..... 74.31760

[52] U.S. Cl. ..... 175/4.6; 102/20

[51] Int. Cl.[2] ..... E21B 43/117; F42B 3/08

[58] Field of Search ..... 175/4.6, 4.51; 102/20, 102/24 HC; 166/299

[56] References Cited

UNITED STATES PATENTS

| | | | |
|---|---|---|---|
| 2,756,677 | 7/1956 | McCullough | 102/20 |
| 2,980,017 | 4/1961 | Castel | 175/4.6 |
| 3,048,101 | 8/1962 | Lebourg | 175/4.6 |
| 3,235,005 | 2/1966 | Delacour | 166/299 |
| 3,282,213 | 11/1966 | Bell et al. | 102/20 |
| 3,282,354 | 11/1966 | Hakala et al. | 175/4.6 |
| 3,327,630 | 6/1967 | Bell | 102/24 HC |
| 3,636,875 | 1/1972 | Dodson | 102/20 |

*Primary Examiner*—Stephen J. Novosad
*Attorney, Agent, or Firm*—Ernest R. Archambeau, Jr.; William R. Sherman; Stewart F. Moore

[57] ABSTRACT

In the representative embodiment of the present invention disclosed herein, this new and improved perforating apparatus includes a unique elongated carrier strip of a ductile steel carrying encapsulated shaped explosive charges having their forward ends fitted and snugly secured against the concave rear face of the strip by means of externally-threaded axial projections respectively threaded into tapped charge-mounting holes closely spaced along the carrier. The forward face of the carrier strip and the rear portions of the capsules are complementally shaped for accommodation within a given size of well bore piping thereby allowing the largest-possible mass of explosive to be disposed in each capsule. To assure that the new and improved perforating apparatus can be used safely in gas-filled well bores without risking either severe distortion or breakage of the carrier, additional openings are arranged in the strip between adjacent charge-mounting openings and cooperatively sized for preferentially inducing a minor transverse bend in the strip across each of these additional openings upon detonation of the adjacent charges instead of allowing the carrier to be severely bent in a substantially-uninterrupted arc or exaggerated bow along its full length.

14 Claims, 4 Drawing Figures

FIG. 1
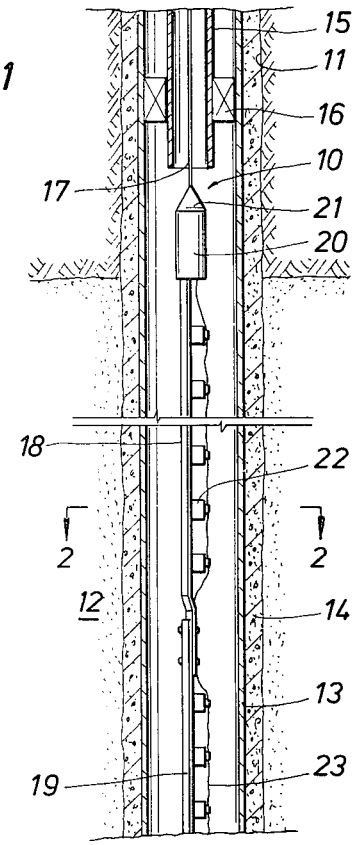
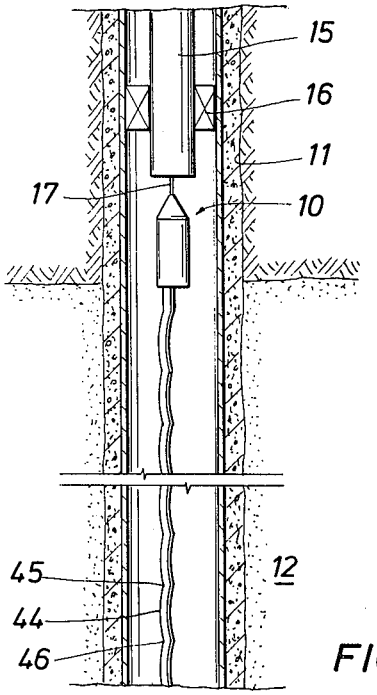
FIG. 4
FIG. 2
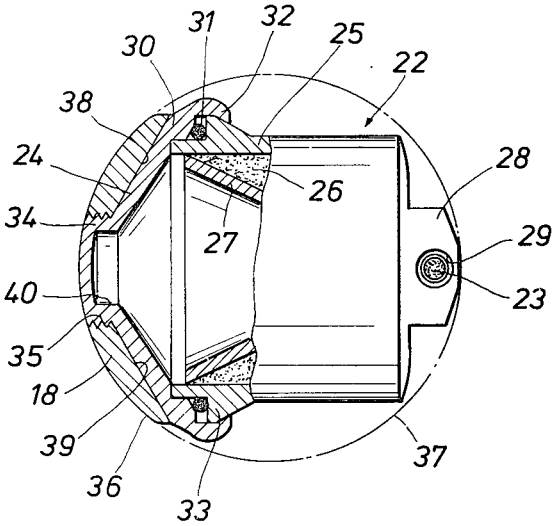
FIG. 3
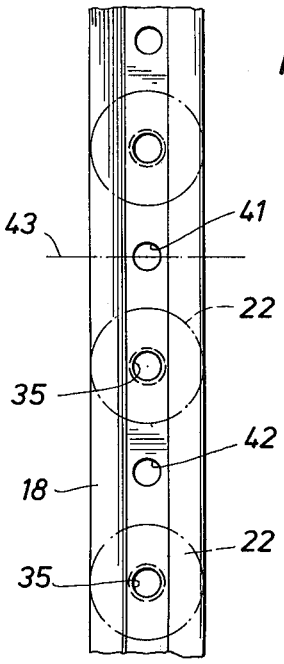

WELL BORE PERFORATING APPARATUS

Those skilled in the art will, of course, appreciate that heretofore many different kinds of expendable perforators using encapsulated shaped explosive charges mounted along a recoverable strip or wire carrier have been employed for through-tubing perforating operations. However, in recent years there has been a substantial decline in the usage of such perforators in at least the United States even though their primary advantage is that they allow the largest-possible charges to be used in a well of a given size. Generally, this loss of popularity is atrributed to such factors as the undesirable amounts of metal fragments or debris which these prior-art perforators ordinarily left in a well bore. For this and similar reasons, the many disintegratible or frangible carriers of the prior art simply failed to ever become popular in commercial operations in the United States.

As discussed at length in U.S. Pat. Nos. 3,282,213 and 3,636,875, many of the recoverable strip or wire carriers of the prior art were at least severely twisted or badly distorted by the extreme explosive forces produced upon detonation of typical capsule charges even when they were operated in liquid-containing well bores. Thus, arrangements such as that shown in U.S. Pat. No. 2,756,677 were often employed to insure that a carrier strip would be preferentially split along its full length thereby minimizing the risk that a badly-twisted carrier might prevent retrieval of the perforating apparatus. Experience has shown, however, that many of the prior-art capsule carriers otherwise suited for service in liquid-containing well bores were often unsuited for operation in gas-filled wells. Thus, except where specially-designed carriers or devices such as those described in the two first-mentioned patents are used, a strip or wire carrier which supports the charges by their sides may ordinarily be expected to break when the perforator is shot in a gas-filled well bore.

It should also be realized that a significant amount of lateral clearance is required to support a capsule by its sides. Thus, even with well-designed mounting arrangements such as that shown in U.S. Pat. No. 3,636,875, the necessary steps taken to avoid unwanted breakage of the supporting wires or strip in a gas-filled well will, in turn, substantially limit the maximum outside diameter of the associated encapsulated charge. This, therefore, results in a corresponding decrease in the amount of explosive which can be provided for a given size of the shaped charge and thereby reduces the performance of that charge.

Accordingly, as described in U.S. Pat. No. 3,177,808, in one mounting arrangement which possibly avoids at least some of the above-discussed problems, the charge capsules are provided with threaded projections which are respectively extended through a hole in a flat metal strip and secured by a threaded nut on the opposite side of the strip. An alternative proposal publicized several years ago was to instead provide threaded charge-mounting holes in the carrier strip and thereby eliminate such retaining nuts. In this alternative front-mounting design, the carrier strips had moderately-curved forward faces and flat rear faces supposedly to provide maximum strength. The charges were screwed into the carrier and angularly positioned as required to allow a length of detonating cord to be extended along a reasonably-straight line from charge to charge.

Nevertheless, experience has shown that carrier strips such as either of those just described are still not necessarily suited for safe or economical operation in gas-filled wells. For example, if the charges are too powerful for a particular strip, the carrier still may be readily severed. On the other hand, if the carrier is of a substantial length, even the sturdiest of such carrier strips will be bent in a continuous curve which commonly will be of such extent that the expended carrier may often become stuck in a small-diameter tubing string as the tool is being retrieved. It should also be recognized that elongated carrier strips which have either side flanges or a semi-oval cross section are even more prone to being extensively deformed along their longitudinal axis inasmuch as such unsymmetrical transverse cross-sectional shapes appear to promote bending of that nature. It will, of course, be recognized that assemblies such as shown in the last-mentioned patent will not be subjected to such undue longitudinal bending in view of the expensive hinged joints tandemly intercoupling the several short carrier strips and inasmuch as their charges are ordinarily spaced much further apart than usual.

As an additional consideration, those skilled in the art will also recognize the critical effects which even small dimensional changes may have upon the performance of any particular front-mounted shaped charge. This influence is, of course, even more pronounced with smaller charges inasmuch as a change in some critical dimension of even a small fraction of an inch can well represent a major percentage of change in the performance of that charge. Thus, where a perforator must be sized for passage through one of the smaller sizes of well tubing, it should be appreciated that even a minor increase in the thickness of a carrier strip required to strengthen it for operation in gas-filled wells will correspondingly significantly reduce the performance of the charges to be carried by it.

Accordingly, it is an object of the present invention to provide new and improved expendable perforating apparatus including an elongated, recoverable carrier strip which is cooperatively arranged and sized to permit the utilization of maximum-performance shaped charges and is also especially adapted for reliably withstanding even the severe explosive forces to be expected when the perforating apparatus of the present invention is operated in a gas-filled well bore.

This and other objects of the present invention are attained by new and improved expendable perforating apparatus including an elongated carrier strip of arcuate cross-section formed of a tough, ductile steel and having alternately-disposed first and second openings longitudinally-spaced at close intervals along the carrier strip. As will be further described in greater detail, these first openings are threaded for cooperatively receiving threaded axial projections respectively provided on the noses of a corresponding number of encapsulated shaped charges to secure the charges in a facing relationship along the rearward concave face of the strip and these second openings are cooperatively sized and located for inducing a minor transverse bend across the carrier strip at each of these second openings when the charges are detonated.

The novel features of the present invention are set forth with particularity in the appended claims. The invention, together with further objects and advantages thereof, may be best understood by way of the following description of exemplary apparatus employing the principles of the invention as illustrated in the accompanying drawings, in which:

FIG. 1 shows a preferred embodiment of new and improved perforating apparatus arranged in accordance with the principles of the present invention as it will appear when positioned for operation in a typical gas-producing well;

FIG. 2 is an enlarged cross-sectional view of the perforating apparatus depicted in FIG. 1 and taken along the lines "2—2" thereof;

FIG. 3 is an enlarged front view of a portion of the new and improved perforating apparatus depicted in FIG. 1; and FIG. 4 is a view similar to that shown in FIG. 1 but illustrates the new and improved perforating apparatus of the present invention after it has been operated.

Turning now to FIG. 1, a preferred embodiment of new and improved perforating apparatus 10 incorporating the principles of the present invention is depicted as it will appear when positioned in a typical well bore 11 penetrating one or more productive earth formations as at 12. As is common, a string of well casing 13 is cemented, as at 14, in the well bore 11 and a smaller-diameter piping string 15 carrying a typical production packer 16 is arranged for communicating the isolated interval therebelow with appropriate wellhead equipment (not shown) at the surface.

AS illustrated, the new and improved perforating apparatus 10 is suspended in the well bore 11 by means of an armored electrical cable 17 which is spooled onto a powered winch (not shown) and electrically connected to a suitable power supply (not shown) adapted for providing sufficient electrical power to the perforator. The perforating apparatus 10 includes one or more elongated carrier strips, as at 18 and 19, which are tandemly intercoupled in a convenient manner and suspended below a typical collar locator 20 and a suitable cable head 21. The new and improved perforating apparatus 10 further includes a plurality of encapsulated shaped charges as at 22 which, as will subsequently be described, are respectively faced in the same direction and each mounted at closely-spaced intervals along the rear of the carrier strips 18 and 19. To provide for selective detonation of the several charges, as at 22, a length of typical detonating cord 23 is extended the full length of the perforating apparatus 10 and cooperatively retained on the rear of each charge capsule. The lower end of the detonating cord 23 is terminated at an electrically responsive detonator (not shown) which is electrically connected to the suspension cable 17 in the usual fashion.

Turning now to FIG. 2, an enlarged, transverse cross sectional view taken along the lines "2—2" in FIG. 1 is shown of the new and improved perforating apparatus 10 for better illustrating the carrier strips, as at 18 and 19, of the present invention as well as to show a preferred arrangement of the unique encapsulated charges 22 which significantly facilitates the installation of the detonating cord 23. As seen there, the encapsulated shaped charges 22 respectively include a hollowed steel case having a domed forward cover 24 and a forwardly-opening hollow container 25 which together cooperate to hold a typical shaped explosive pellet 26 carrying a conical metallic liner 27. The particular steel employed and various thicknesses used for a given design of the cases of the charges 22 will, of course, be in keeping with whatever design operating pressure is selected. As is typical, the base of the container 25 is provided with an enlarged boss 28 having a transverse opening 29 arranged therein for receiving the detonating cord 23 and positioning it as required for reliably detonating the charge 22. In the preferred embodiment of the charges 22, each has its domed cover 24 circumferentially enlarged, as at 30, and complementally shaped for receiving the forward, open portion of its container 25 and carrying a sealing memmber, such as an O-ring 31, in sealing engagement between opposing surfaces of the two case members.

During the manufacture of each unique shaped charge 22, its cover 24 is shaped for being crimped to form a peripheral lip 32 extending over and turning inwardly over the rear surface of an outwardly-enlarged shoulder 33 defined around its container 25. However, in sharp contrast to the usual practice of heretofore tightly or solidly crimping two case members together (such as shown, for example, in FIG. 8 of U.S. Pat. No. 3,235,005), the lip 32 is instead only snugly or firmly crimped in position over the container shoulder 33 so that a moderate twisting force will be sufficient for turning the container 25 angularly in relation to its cover 24. The significance of this unique arrangement will be subsequently explained.

Each of the encapsulated charges 22 is provided with an externally-threaded axial projection, as at 34, which extends forwardly from the charge cover 24 and is cooperatively arranged for threaded reception within a selected one of a plurality of tapped charge-mounting openings, as at 35, which are centrally located and closely spaced along the length of the carrier strips as at 18. As depicted in FIG. 2, the closed forward ends of these axial projections 34 are respectively arranged to be substantially flush with the forward faces, as at 36, of the carrier strips as at 18. The forward faces 36 of the strips 18 and 19 are rounded or complementally shaped as required for passage through a given minimum size of typical well tubing. Similarly, the rear of the boss 28 is appropriately shaped so as to not project outside of an imaginary circle of a selected diameter, as at 37, as may be defined by the arcuately-shaped forward faces 36 of the carrier strips as at 18. This preferred arrangement will, therefore, enable the perforating apparatus 10 to be passed through any piping string, as at 15, having an internal bore which is at least slightly larger than the imaginary circle 37.

It will also be noted from FIG. 2, that the carrier strips, as at 18, are at least approximately of a uniform thickness thereby defining a rearwardly-opening concavity preferably with generally-flat, outwardly-diverging rearward faces, as at 38 and 39, along the full length of the strips. Thus, as depicted, the forward faces of the domed capsule covers, as at 24, are each complementally shaped to fit at least a major portion of the adjacent rearward faces 38 and 39 of the carrier strips, as at 18. In the preferred embodiment of the new and improved perforating apparatus 10, it has been found beneficial to form these rearward faces 38 and 39 to diverge at an angle just slightly less than the complemental included angle defined by the mating forward surfaces of the capsule covers 24 so as to better insure a tight or locking fit between their respective co-engaged surfaces once the charges 22 are mounted on the carrier strips as at 18.

Those skilled in the art will, of course, understand the importance of providing a maximum unimpeded clearance or so-called "stand-off" ahead of a shaped charge. In general, the penetrating capability of a given shaped charge will increase in direct relation to the axial distance that a perforating jet can travel as it is being formed before meeting an obstruction. Thus, in sharp contrast to those prior-art carriers previously described as having flat rearward faces, witl all else being equal it will be appreciated that the crescent-like transverse cross-section of the new and improved carrier strips 18 and 19 of the present invention will provide a substantial and very significant increase in the available stand-off distance for the encapsulated charges as at 22.

It should also be realized that by hollowing the axial projections, as at 40, the available stand-off distance is even further increased by a significant amount almost equal to the length of the threaded projections 34. Another significant factor to be noted is that the concavity defined by the rearward faces, as at 38 and 39, of the carrier strips 18 and 19 will permit the interior of the charge covers 24 to be cooperatively shaped so as to position the rearward entrances of the internal bores 40 slightly ahead of the forwardly-directed, inwardly-convergent paths which will be followed by those liner particles forming the rear portions of the perforating jets produced upon detonation of the charges 22. Those skilled in the art will, therefore, appreciate that significant and often major increases in penetration for given charge designs are achieved by significantly increasing the available stand-off distance, by insuring that there will be little or no unwanted interference with the formation of their resulting jets, and also by allowing a maximum amount of the explosive 26 to be used in a given one of the charges 22. For such reasons, it will be understood that the perforating apparatus 10 of the present invention will provide optimum performance.

As previously discussed, however, the severe and quite-substantial explosive forces which will be developed when an encapsulated shaped charge, as at 22, is detonated in a gas-filled well, as at 11, are ordinarily sufficient to at last seriously deform, if not altogether break, the various carrier strips of the prior art. This tendency is, of course, greatly accentuated, if not significantly increased, by any improvements in overall charge performance such as those just discussed with respect to the charges 22. Thus, the usual practice heretofore has been to simply strengthen these prior-art carrier strips such as by shaping them in a semi-oval cross-section as previously described even though such strengthening ordinarily results in a corresponding decrease in perforating capability.

In keeping with the objects of the present invention, however, it has been found that breakage as well as undue distortion or longitudinal bending of the carrier strips, as at 18, may be avoided by uniquely arranging the carrier strips of the invention to instead be only moderately bent in successive, small incremental lengths, with the net result being that these expended carriers will neither break nor become excessively deformed. In the preferred manner of achieving this unique result, as best seen in FIG. 3 the several new and improved carrier strips 18 and 19 are respectively arranged to also uniquely include a number of additional openings, as at 41 and 42, which are spatially distributed at uniform intervals along each carrier strip and interposed between adjacent ones of the charge-mounting holes as at 35. It will be appreciated by those skilled in the art that since it is commonly desired to position shaped charges at three-inch intervals, the charge-mounting holes, as at 35, are preferably arranged at that spacing along the carrier strips 18 and 19; and, therefore, the additional openings, as at 41 and 42, will be respectively disposed midway between adjacent mounting holes.

As mentioned in U.S. Pat. No. 3,048,101, for example, it is typical to use a ductile, moderately-flexible steel for carrier strips such as shown in that patent. Similarly, as discussed in some detail in U.S. Pat. No. 3,282,213, it is known that relatively-ductile and generally-malleable steels (such as AISI 1018 steel) have sufficient toughness for reliably withstanding severe detonation forces. Accordingly, in the preferred embodiment of the new and improved strips 18 and 19 of the present invention, successful operations have been achieved with steels having a maximum elongation (i.e., elongation at the point of tensile failure) of between 10% and 15%, a breaking strength between 70 and 90-hectobars, and an impact strength of 3 to 7 -decajoules/cm$^2$.

When a steel such as just described is employed, it has been found satisfactory and most convenient to simply arrange these additional openings, as at 41 and 42, to be circular holes of the same diameter as the threaded charge-mounting holes as at 35. Those skilled in the art will, of course, recognize how advantageous this will be in mass-producing carrier strips as at 18 and 19. There is, however, no need to thread these additional openings 41 and 42 since their sole function is to induce limited preferential bending of the carrier strips 18 and 19 along transverse axes (as at 43) respectively passing through each of those several openings. Accordingly, as illustrated in FIG. 4, it has been found that when the new and improved perforating apparatus 10 of the present invention is operated in a gas-filled well bore, as at 11, the carrier strips 18 and 19 will be harmlessly deformed into a series of spatially-disposed bowed protrusions or successive, longitudinally spaced arches, as at 44, of such a limited height that the expended strips can be readily retrieved through the small-diameter tubing string 15. As depicted, it will be recognized that the peaks of these successive arches, as at 44, are respectively centered about a charge-mounting hole, as at 35, and their terminations, as at 45 and 46, are generally centered along one of the axes 43 crossing the intermediately-located deformation-inducing holes, as at 41 and 42.

Although explanations of the principles of operation are believed unnecessary it is appropriate to simply point out that to accomplish the objects of the present invention, the deformation-inducing holes, as at 41 and 42, must be cooperatively sized in keeping with the type of steel used in the carrier strips 18 and 19, the particular dimensional sizes involved throughout a given design of the perforating apparatus 10, and the maximum deformation-inducing forces which can be developed by a given one of the charges 22. Thus, once these several factors are either selected or determined either through calculations or by empirical methods, the deformation-inducing openings such as defined by the circular holes 41 and 42 can be readily arranged and sized as required for achieving the controlled deformation as shown in FIG. 4.

As previously mentioned, the several shaped charges 22 are uniquely manufactured so as to facilitate the turning of their containers 25 at least slightly in relation to their respective covers 24. This ability is, of course, contrary to the usual practice of tightly fitting the two halves of prior-art charge containers. Accordingly, once the charges 22 are respectively mounted along the carrier strips as at 18 and 19, this freedom of movement will allow these covers 24 to be first tightly fitted against the back sides of the carrier strips and then allow the containers 25 to be respectively turned as required to successively align the several cord-receiving holes, as at 29, for rapid installation of the detonating cord 23.

Accordingly, it will be appreciated that the present invention has provided new and improved perforating apparatus especially adapted for operation in gas-filled well bores including an elongated support member of a tough, ductile steel having an arcuately-shaped transverse cross-section and carrying a plurality of encapsulated shaped charges which are secured in a facing relationship against the concave rear surface of the support by means of threaded axial projections on the noses of the charge capsules that are respectively tightly engaged within threaded first openings distributed longitudinally along the support member. To avoid excessive deformation of the steel support member, a series of second openings alternately distributed along the support member and respectively located about midway between the first openings are cooperatively sized for inducing limited bending of the support about transverse axes crossing each of these second openings so that the expended support will be controllably deformed into a series of moderate arches successively distributed along the support and between the transverse bending axes.

While only a particular embodiment of the present invention has been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. Perforating apparatus adapted for passage through well piping and including:

an elongated carrier strip with an arcuately-shaped transverse cross section of substantially-uniform thickness formed of a tough ductile steel and having a plurality of internally threaded laterally-directed charge-mounting openings spatially disposed along the longitudinal axis of said carrier strip;

perforating means on said carrier strip and including a plurality of encapsulated shaped explosive charges respectively having an externally-threaded axial projection extending forwardly therefrom and adapted for threaded engagement in said charge-mounting openings for securing said shaped charges in a facing relationship against the concave rearward face of said carrier strip; and deformation-inducing means responsive to explosive forces imposed on said carrier strip upon detonation of said shaped charges for inducing successive transversely-directed bends across said carrier strip which are respectively located about midway between adjacent ones of said charge-mounting openings.

2. The perforating apparatus of claim 1 wherein said charge-mounting openings are holes spaced at equal intervals of about three inches along at least a major portion of the overall length of said carrier strip.

3. The perforating apparatus of claim 1 wherein said carrier strip is formed of a steel having an approximate maximum elongation of between 10% and 15% at tensile failure, an approximate tensile strength of between 70 and90-hectobars, and an approximate impact strength of between 3 to 7-decajoules/cm$^2$.

4. The perforating apparatus of claim 1 wherein said deformation-inducing means include a plurality of additional openings in said carrier strip and respectively located about midway between adjacent ones of said charge-mounting openings.

5. The perforating apparatus of claim 4 wherein said additional openings are spatially disposed along said longitudinal axis of said carrier strip.

6. The perforating apparatus of claim 1 wherein said deformation-inducing means consist of a corresponding number of circular holes spatially disposed along said longitudinal axis of said carrier strip.

7. The perforating apparatus of claim 6 wherein said circular holes are approximately the same size as said charge-mounting openings.

8. Perforating apparatus adapted for passage through well piping and comprising:

an elongated charge-support member formed of a tough ductile steel and having a convex forward face complementally curved for approximately fitting the interior wall of well piping of a selected internal diameter and a concave rearward face approximately parallel to said outer face and spaced uniformly therefrom;

means on said charge-support member and including a plurality of first openings spatially disposed along said charge-support member and internally threaded for respectively receiving a threaded axial protrusion on the nose of an encapsulated shaped explosive charge and securing it in facing relationship against said concave rearward face;

means on said charge-suppport member and including a plurality of second openings respectively disposed along said charge-support member between adjacent ones of said first openings and cooperatively sized for inducing transverse bends of limited magnitude respectively crossing each of said second openings upon detonation of spaced explosive charges secured in said first openings.

9. The perforating apparatus of claim 8 wherein said first openings are spaced at equal intervals of no more than about three inches along at least a major portion of the overall length of said charge-support member.

10. The perforating apparatus of claim 8 wherein said charge-support member is formed of a steel having an approximate maximum elongation of between 10% and 15% at tensile failure, an approximate tensile strength of between 70 and 90-hectobars, and an approximate impact strength of between 3 to 7-decajoules/cm$^2$.

11. The perforating apparatus of claim 8 wherein said second openings are respectively located about midway between adjacent ones of said first openings.

12. The perforating apparatus of claim 11 wherein said second openings are spatially disposed along said longitudinal axis of said charge-support member.

13. The perforating apparatus of claim 8 wherein said second openings consist of a corresponding number of circular holes spatially disposed along said longitudinal axis of said carrier strip.

14. The perforating apparatus of claim 13 wherein said second openings are approximately the same size as said first openings.

* * * * *